US009761193B2

(12) United States Patent
Kim et al.

(10) Patent No.: US 9,761,193 B2
(45) Date of Patent: Sep. 12, 2017

(54) LIQUID CRYSTAL DISPLAY AND DRIVING METHOD THEREOF

(71) Applicant: Samsung Display Co., Ltd., Yongin-si, Gyeonggi-do (KR)

(72) Inventors: Hoon Kim, Ansan-si (KR); Jae Hoon Jung, Anyang-si (KR); Ki Chul Shin, Seongnam-si (KR); Jae Jin Lyu, Yongin-si (KR)

(73) Assignee: Samsung Display Co., Ltd. (KR)

( * ) Notice: Subject to any disclaimer, the term of this patent is extended or adjusted under 35 U.S.C. 154(b) by 22 days.

(21) Appl. No.: 14/836,846

(22) Filed: Aug. 26, 2015

(65) Prior Publication Data

US 2016/0155404 A1 Jun. 2, 2016

(30) Foreign Application Priority Data

Nov. 28, 2014 (KR) ..... 10-2014-0169120

(51) Int. Cl.
*G09G 3/36* (2006.01)

(52) U.S. Cl.
CPC ... *G09G 3/3659* (2013.01); *G09G 2300/0447* (2013.01)

(58) Field of Classification Search
None
See application file for complete search history.

(56) References Cited

U.S. PATENT DOCUMENTS 8,952,978 B2 * 2/2015 Ogita ..... G09G 3/3611 345/589
2002/0158993 A1 * 10/2002 Murai ..... G09G 3/2011 349/38
2004/0164943 A1 * 8/2004 Ogawa ..... G09G 3/3655 345/92
2006/0007091 A1 * 1/2006 Yang ..... G09G 3/3648 345/89
2006/0119756 A1 * 6/2006 Shin ..... G02F 1/13624 349/38
2006/0132415 A1 * 6/2006 Yu ..... G09G 3/3655 345/98

(Continued)

FOREIGN PATENT DOCUMENTS

KR 10-2012-0139451 A 12/2012
KR 10-2014-0000459 A 1/2014
KR 10-2014-0097905 A 8/2014

*Primary Examiner* — Chad Dicke
(74) *Attorney, Agent, or Firm* — Innovation Counsel LLP

(57) ABSTRACT

A liquid crystal display (LCD) includes: a display panel including a plurality of pixels connected to a gate line, a data line, and a reference voltage line to which a common voltage is applied; a data driver connected to the data line and configured to apply a data voltage to the data line; a gate driver connected to the gate line and configured to apply a gate voltage to the gate line; a reference voltage generator connected to the reference voltage line and configured to apply a reference voltage to the reference voltage line; and a signal controller configured to control the data driver, the gate driver, and the reference voltage generator, and output a signal to the reference voltage generator for changing the reference voltage applied to the pixels, wherein the reference voltage is changed according to a gray-level value of an image data.

11 Claims, 7 Drawing Sheets

(56) References Cited

U.S. PATENT DOCUMENTS

2006/0164356 A1* 7/2006 Yang ..... G09G 3/3611 345/89
2007/0057297 A1* 3/2007 Kim ..... G02F 1/136213 257/291
2007/0103416 A1* 5/2007 Kim ..... G09G 3/3611 345/88
2007/0120797 A1* 5/2007 Lin ..... G02F 1/133555 345/92
2007/0164966 A1* 7/2007 Okita ..... G02F 1/1395 345/98
2007/0279433 A1* 12/2007 Huang ..... G09G 3/3607 345/601
2008/0007506 A1* 1/2008 Chen ..... G09G 3/3659 345/92
2008/0122814 A1* 5/2008 Shin ..... G09G 3/3648 345/204
2008/0165299 A1* 7/2008 Huang ..... G09G 3/3659 349/38
2008/0272998 A1* 11/2008 Yano ..... G09G 3/2051 345/89
2009/0122000 A1* 5/2009 Chen ..... G09G 3/3406 345/102
2009/0244111 A1* 10/2009 Yang ..... G09G 3/3648 345/690
2011/0148833 A1* 6/2011 Luo ..... G09G 3/344 345/207
2012/0105785 A1* 5/2012 Kim ..... G09G 3/3648 349/139
2012/0162559 A1* 6/2012 Kim ..... G02F 1/134363 349/42
2012/0236245 A1* 9/2012 Jung ..... G02F 1/134336 349/144
2012/0320019 A1* 12/2012 Jeong ..... G09G 3/2096 345/211
2013/0083263 A1* 4/2013 Kim ..... G02F 1/134336 349/38
2013/0194170 A1* 8/2013 Saitoh ..... G09G 3/20 345/103
2013/0201166 A1* 8/2013 Wang ..... G09G 3/18 345/204
2013/0335688 A1* 12/2013 Jung ..... G02F 1/134336 349/130
2014/0267994 A1* 9/2014 Ryu ..... G02F 1/13439 349/141
2015/0029455 A1* 1/2015 Kim ..... G02F 1/133753 349/129
2015/0049289 A1* 2/2015 Jang ..... G02F 1/133707 349/142
2015/0146126 A1* 5/2015 Shin ..... G02F 1/134309 349/43

* cited by examiner

LIQUID CRYSTAL DISPLAY AND DRIVING METHOD THEREOF

CROSS-REFERENCE TO RELATED APPLICATION

This application claims priority to and the benefit of Korean Patent Application No. 10-2014-0169120 filed in the Korean Intellectual Property Office on Nov. 28, 2014, the entire contents of which are incorporated herein by reference.

BACKGROUND (a) Technical Field

The present disclosure generally relates to a liquid crystal display (LCD) having improved lateral display quality and a method of driving the same.

(b) Description of the Related Art

Liquid crystal displays (LCDs) are one of the most widely used flat panel displays at present. A liquid crystal display (LCD) typically includes two display panels on which field generating electrodes (such as a pixel electrode and a common electrode) are formed, and a liquid crystal layer interposed between the two display panels.

When a voltage is applied to the field generating electrodes, an electric field is generated on the liquid crystal layer. The electric field determines the alignment directions of liquid crystal molecules of the liquid crystal layer and controls polarization of incident light passing through the liquid crystal layer, so as to display an image on the LCD.

The LCD further includes switching elements coupled to each pixel electrode, and a plurality of signal lines (such as gate lines and data lines) that control the switching elements to apply a voltage to the pixel electrode.

LCDs may be provided in different modes and configurations. For example, in a vertically aligned mode LCD, liquid crystal molecules are aligned so that their long axes are perpendicular to the upper and lower panels in the absence of an electric field. In particular, the vertically aligned mode LCD has high contrast ratio and a wide reference viewing angle. The reference viewing angle refers to a viewing angle at which a contrast ratio is 1:10, or a luminance inversion limit angle between grays.

For the vertically aligned mode LCD, a method has been proposed to render the side visibility similar to the front visibility. Specifically, the method includes dividing a pixel into two subpixels having different transmittance by applying different voltages to the two subpixels.

However, when a pixel is divided into two subpixels having different transmittance, luminance may increase at a low grayscale or a high grayscale and affect the gray expression at the lateral sides of the display panel, thereby causing picture quality to deteriorate. In addition, when a pixel is divided into two subpixels, transmittance may decrease due to a gap between the two subpixels.

The above information disclosed in this Background section is to enhance understanding of the background of the inventive concept and may contain information that does not constitute prior art that is already known in this country to a person of ordinary skill in the art.

SUMMARY

The present disclosure addresses at least the above issues relating by providing a liquid crystal display (LCD) in which its side visibility is similar to its front visibility. The LCD has accurate gray-level expression at low and intermediate gray levels, and improved transmittance.

According to an embodiment of the inventive concept, a liquid crystal display (LCD) is provided. The LCD includes: a display panel including a plurality of pixels connected to a gate line, a data line, and a reference voltage line to which a common voltage is applied; a data driver connected to the data line and configured to apply a data voltage to the data line; a gate driver connected to the gate line and configured to apply a gate voltage to the gate line; a reference voltage generator connected to the reference voltage line and configured to apply a reference voltage to the reference voltage line; and a signal controller configured to control the data driver, the gate driver, and the reference voltage generator, and output a signal to the reference voltage generator for changing the reference voltage applied to the pixels, wherein the reference voltage is changed according to a gray-level value of an image data.

In some embodiments, the LCD may further include: a memory containing information about a specific gray-level value, wherein the signal controller may be configured to compare the specific gray-level value with the gray-level value of the image data, so as to output the signal to the reference voltage generator for changing the reference voltage.

In some embodiments, the specific gray-level value may be determined using a first transmittance measured at a lateral side of the display panel when the reference voltage is identical to the data voltage, and a second transmittance measured at the lateral side of the display panel when the reference voltage is higher than the common voltage by more than a predetermined level.

In some embodiments, the specific gray-level value may be determined to be a gray-level value at a point which a curve of the first transmittance measured at the lateral side of the display panel crosses a curve of the second transmittance measured at the lateral side of the display panel.

In some embodiments, the signal controller may be configured to output the signal to the reference voltage generator for changing the reference voltage, such that the reference voltage may be identical to the data voltage when the gray-level value of the image data exceeds the specific gray-level value.

In some embodiments, the signal controller may be configured to output the signal to the reference voltage generator for changing the reference voltage, such that the reference voltage may be higher than the common voltage by more than a predetermined level when the gray-level value of the image data is below the specific gray-level value.

In some embodiments, the data line and the reference voltage line may be disposed parallel to each other.

In some embodiments, the pixel may include a high gray-level subpixel and a low gray-level subpixel, the high gray-level subpixel may include a high gray-level liquid crystal capacitor and a high gray-level switching element, the low gray-level subpixel may include a low gray-level liquid crystal capacitor, a low gray-level switching element, and an auxiliary switching element, wherein the reference voltage may be applied to an output terminal of the auxiliary switching element.

In some embodiments, an input terminal of the auxiliary switching element may be connected to an output terminal of the low gray-level switching element, and a control terminal of the auxiliary switching element may be connected to the same gate line as a control terminal of the low gray-level switching element.

In some embodiments, the pixel may include a horizontal-type pixel.

According to another embodiment of the inventive concept, a method of driving a liquid crystal display (LCD) is provided. The method includes: receiving an image data; comparing a gray-level value of the image data with a specific gray-level value to obtain a comparison result; and changing, based on the comparison result, a reference voltage applied to a pixel, such that the reference voltage is higher than one of a data voltage and a common voltage applied to the pixel by a predetermined level.

In some embodiments, the specific gray-level value may be determined using a first transmittance measured at a lateral side of a display panel when the reference voltage is identical to the data voltage, and a second transmittance measured at the lateral side of the display panel when the reference voltage is higher than the common voltage by more than the predetermined level.

In some embodiments, the specific gray-level value may be determined to be a gray-level value at a point which a curve of the first transmittance measured at the lateral side of the display panel crosses a curve of the second transmittance measured at the lateral side of the display panel.

In some embodiments, changing the reference voltage may include making the reference voltage identical to the data voltage when the gray-level value of the image data exceeds the specific gray-level value.

In some embodiments, changing the reference voltage may include making the reference voltage higher than the common voltage by more than the predetermined level when the gray-level value of the image data is below the specific gray-level value.

In some embodiments, when the pixel includes a high gray-level subpixel and a low gray-level subpixel, the high gray-level subpixel may include a high gray-level liquid crystal capacitor and a high gray-level switching element, and the low gray-level subpixel may include a low gray-level liquid crystal capacitor, a low gray-level switching element, and an auxiliary switching element: the reference voltage may be applied to an output terminal of the auxiliary switching element such that the data voltage is divided by the low gray-level liquid crystal capacitor.

DETAILED DESCRIPTION

Figure 1:
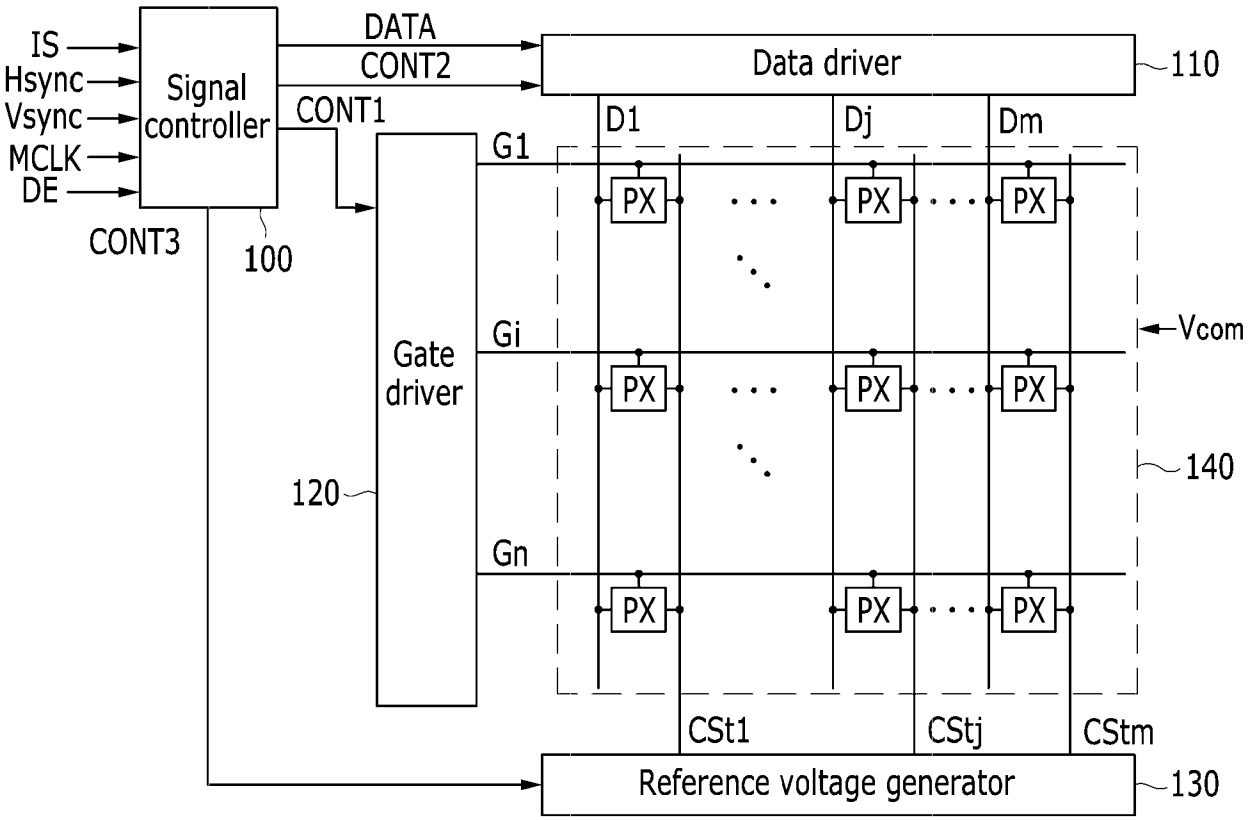
FIG. 1 is a block diagram of a liquid crystal display (LCD) according to an exemplary embodiment.

Exemplary embodiments will be herein described in detail with reference to the accompanying drawings. In the specification, same or similar components will be denoted by the same or similar reference numerals, and a repeat description of those same or similar components will be omitted.

It should be noted that terms such as "module" and "unit" may be used in the following description to distinguish different components.

Furthermore, in the interest of clarity and to avoid obscuring the inventive concept, a detailed description of features known to those of ordinary skill in the art may be omitted when describing the embodiments.

In addition, the accompanying drawings are provided to illustrate the embodiments and should not be construed as limiting the inventive concept. Also, different modifications, equivalents, and substitutions may be made to the embodiments without departing from the scope and spirit of the inventive concept.

Terms such as "first," "second," and the like, may be used to distinguish one component from one another, and should not interpreted as limiting those components. Thus, a first component described below could be easily termed a second component without departing from the teachings of the present disclosure.

It is to be understood that when a component is referred to as being "connected" or "coupled" to another component, it may be connected or coupled directly to another component, or connected or coupled to another component with one or more intervening components.

On the other hand, it is to be understood that when a component is referred to as being "connected or coupled directly" to another component, the component may be coupled or connected to another component without any intervening components.

Singular forms are to include plural forms unless the context clearly indicates otherwise.

It will be further understood that the terms "comprise" or "include" as used in the specification specify the presence of stated features, numerals, steps, operations, components, parts, or a combination thereof, but do not preclude the presence or addition of one or more other features, numerals, steps, operations, components, parts, or a combination thereof.

Figure 2:
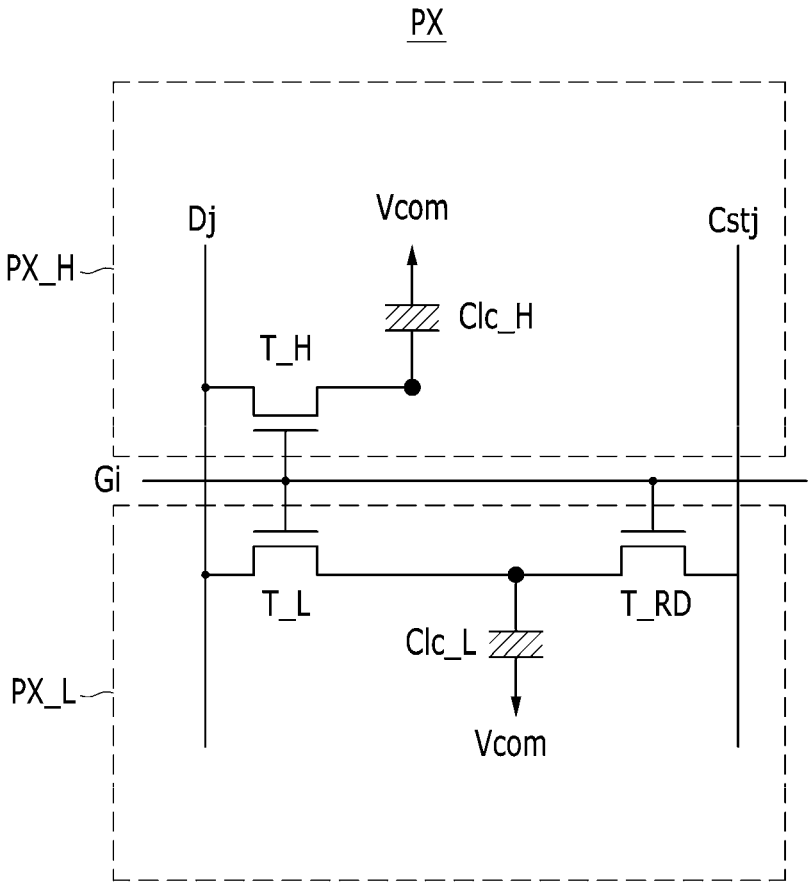
FIG. 2 is a circuit diagram of a pixel in the LCD of FIG. 1.

FIG. 1 is a block diagram of a liquid crystal display (LCD) according to an exemplary embodiment, and FIG. 2 is a circuit diagram of a pixel in the LCD of FIG. 1.

Referring to FIG. 1, the LCD includes a display panel 140, a gate driver 120, a data driver 110, a reference voltage generator 130, and a signal controller 100. The data driver 110, the gate driver 120, and the reference voltage generator 130 are connected to the display panel 140, and are controlled by the signal controller 100.

When depicted as an equivalent circuit, the display panel 140 includes a plurality of signal lines, and a plurality of pixels PX connected to the signal lines and arranged approximately in a matrix form.

The display panel 140 may include a lower panel (not shown) and an upper panel (not shown) facing each other, and a liquid crystal layer (not shown) interposed therebetween.

The signal lines include a plurality of gate lines G1 to Gn for transmitting a gate signal (referred to as a "scanning signal" or "scan signal"), a plurality of data lines D1 to Dm for transmitting a data voltage, and a plurality of reference voltage lines Cst1 to Cstm for transmitting a reference voltage. The reference voltage lines are disposed substantially parallel to the data lines.

Referring to FIG. 2, a pixel PX in the LCD according to the exemplary embodiment may be connected to the plurality of signal lines including a gate line Gi for transmitting the gate signal, a data line Dj for transmitting the data signal, and a reference voltage line Cstj for transmitting the reference voltage.

In addition, a common voltage Vcom may be provided to the pixel PX.

Each pixel (PX) may display one of primary colors (spatial division) or alternately display primary colors over time (temporal division), thereby enabling a desired color to be recognized as a spatial or temporal summation of the primary colors.

A plurality of adjacent pixels PX displaying different primary colors may collectively constitute a set (referred to as a dot).

In addition, each pixel PX includes a first switching element T_H, a second switching element T_L, and a third switching element T_RD that are connected to the plurality of signal lines, and first and second liquid crystal capacitors Clc_H and Clc_L.

The first and second switching elements T_H and T_L are connected to the gate line Gi and the data line Dj, and the third switching element T_RD is connected to an output terminal of the second switching element T_L and the reference voltage line Cstj.

The first and second switching elements T_H and T_L are three-terminal elements such as thin film transistors and the like. Control terminals of the first and second switching elements T_H and T_L are connected to the gate line Gi, and input terminals of the first and second switching elements T_H and T_L are connected to the data line Dj.

An output terminal of the first switching element T_H is connected to the first liquid crystal capacitor Clc_H, and an output terminal of the second switching element T_L is connected to the second liquid crystal capacitor Clc_L and an input terminal of the third switching element T_RD.

The third switching element T_RD is also a three-terminal element such as a thin film transistor and the like. A control terminal of the third switching element T_RD is connected to the gate line Gi, an input terminal of the third switching element T_RD is connected to the second liquid crystal capacitor Clc_L, and an output terminal of the third switching element T_RD is connected to the reference voltage line Cstj.

When a gate-on signal is applied to the gate line Gi, the first, second, and third switching elements T_H, T_L, and T_RD connected thereto are turned on.

Accordingly, the data voltage applied to the data line Dj is applied to both a first subpixel PX_H and a second subpixel PX_L through the turned-on first and second switching elements T_H and T_L.

Subsequently, the data voltage may be equally divided by the first and second subpixels PX_H and PX_L.

However, in the embodiment of FIG. 2, the voltage applied to the second subpixel PX_L may be further divided by the third switching element T_RD that is serially connected to the second switching element T_L.

Accordingly, the voltages charged to the first and second liquid crystal capacitors Clc_H and Clc_L are different from each other.

Since the voltages charged to the first and second liquid crystal capacitors Clc_H and Clc_L are different from each other, tilt angles of liquid crystal molecules of the first and second subpixels PX_H and PX_L would be different, thereby enabling two subpixels of different luminances.

Accordingly, when the voltages charged to the first and second liquid crystal capacitors Clc_H and Clc_L are appropriately adjusted, an image viewed from a front side would be similar to an image viewed from a lateral side, thereby improving side visibility.

A size of the second subpixel PX_L may be one to three times larger than that of the first subpixel PX_H. For example, in the exemplary embodiment, the size of the second subpixel PX_L may be 1.5 to 2.5 times larger than that of the first subpixel PX_H.

It should be noted that the circuit structure of the pixel illustrated in FIG. 2 may be applied to a vertically long pixel (herein referred to as a vertical-type pixel), as well as a horizontally long pixel (herein referred to as a horizontal-type pixel).

However, reduced transmittance makes it difficult to add a separate configuration (in which a high gray-level subpixel and a low gray-level subpixel are charge-shared) to the horizontal type pixel. Accordingly, the pixel structure shown in FIG. 2 may be preferably used in the horizontal type pixel. In particular, an auxiliary switching element (in the form of the third switching element T_RD) is included in the pixel structure of FIG. 2.

Referring back to FIG. 1, the gate driver 120 is connected to the gate lines G1 to Gn, and applies the gate signal comprising a combination of gate-on and gate-off voltages to the gate lines G1 to Gn according to a gate control signal CONT2.

The data driver 110 selects a voltage according to an image data signal DATA, and transmits the voltage as the data signal to the plurality of data lines D1 to Dm.

The data driver 110 samples and holds the image data signal DATA that is received according to a data control signal CONT1, and transmits a plurality of data signals to the plurality of data lines D1 to Dm.

For example, the data driver 110 may apply the data signal having a predetermined voltage range to the plurality of data lines in response to the gate signal of the gate-on voltage.

The signal controller 100 receives an input image signal IS and an input control signal for controlling display of the input image signal IS. The input control signal may be received from an external source.

The image signal IS may include luminance information differentiating gray levels of the pixels PX of the display panel 140.

Examples of the input control signal transmitted to the signal controller 100 include a vertical synchronization signal Vsync, a horizontal synchronization signal Hsync, a main clock signal MCLK, a data enable signal DE, etc.

The signal controller 100 generates the data control signal CONT1, the gate control signal CONT2, a reference voltage control signal CONT3, and the image data signal DATA according to the image signal IS, the horizontal synchronization signal Hsync, the vertical synchronization signal Vsync, the main clock signal MCLK, and the data enable signal DE.

Based on the input image signal IS and the input control signal, the signal controller 100 appropriately image-processes the image signal IS such that the processed image signal IS satisfies operating conditions of the display panel 140 and the data driver 110.

Specifically, the signal controller 100 may generate the image data signal DATA by performing image processing such as gamma correction, luminance compensation, etc. for the image signal IS.

For example, the signal controller 100 generates the data control signal CONT1 for controlling an operation of the data driver 110, and transmits the data control signal CONT1 along with the image-processed image data signal DATA to the data driver 110.

In addition, the signal controller 100 transmits the gate control signal CONT2 to the gate driver 120 for controlling an operation of the gate driver 120.

Furthermore, the signal controller 100 may generate the reference voltage control signal CONT3 for controlling an operation of the reference voltage generator 130.

The reference voltage generator 130 may generate and transmit the reference voltage corresponding to each pixel PX of the display panel 140.

A memory is configured to store each specific gray-level value. In addition, the memory outputs the specific gray-level values to the signal controller 100. The memory may be integrated into the signal controller 100.

The specific gray level may be determined using a plurality of transmittance curves. A transmittance curve refers to a curved line representing luminances or transmittances for the gray levels of the input image signal, and the specific gray-level voltage can be determined using the curved line, as described later in the specification.

Figure 3:
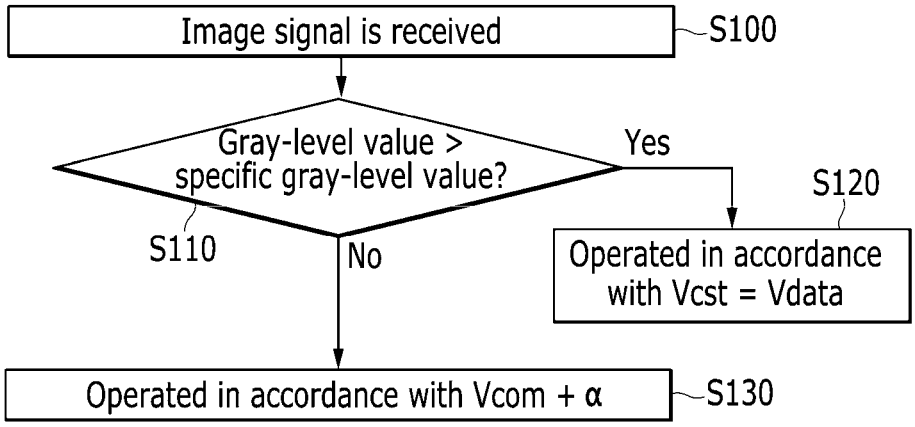
FIG. 3 is a flowchart of an exemplary method of driving the LCD of FIG. 1.

FIG. 3 is a flowchart of an exemplary method of driving the LCD of FIG. 1.

An image signal is received by a signal controller 100 (Step S100). The image signal includes each gray-level data for subpixels of red (R), green (G), and blue (B).

Next, the signal controller 100 determines whether the gray-level data of the input image signal exceeds a specific gray-level value (Step S110). In addition, the signal controller 100 may determine all gray-level data in the image signal corresponding to one frame. Steps S120 and S130 will be described in detail with reference to FIGS. 5, 6, and 7.

Figure 4:
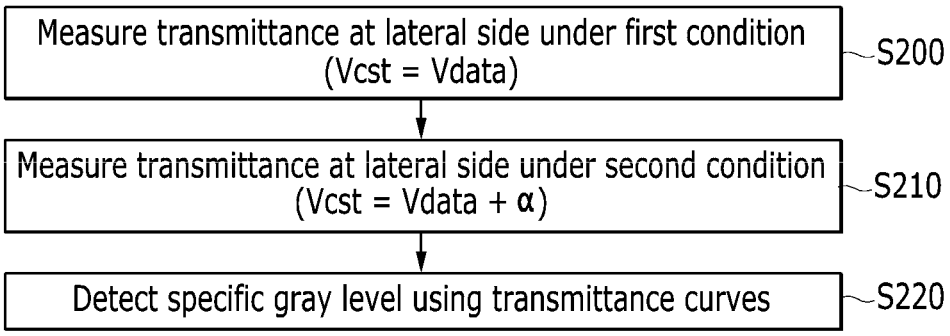
FIG. 4 is a flowchart of an exemplary method of determining a specific gray level according to an embodiment.

FIG. 4 is a flowchart of an exemplary method of determining a specific gray level according to an embodiment.

First, transmittances at a lateral side for all gray levels are measured under a condition in which a reference voltage is identical to a data voltage (Step S200).

Next, transmittances at the lateral side for all the gray levels are measured under a condition in which the reference voltage is higher than a common voltage (Step S210). For example, the reference voltage may be higher than the common voltage by more than a predetermined level α.

In Steps S200 and S210, it may be assumed that a ratio of a size of a first subpixel PX_H to a size of a second subpixel PX_L is set to 1:2.5, and a ratio of a voltage of the first subpixel PX_H to a voltage of the second subpixel PX_Ls is set to 0.7.

Next, in Step S220, the specific gray level is determined using a transmittance curve measured at the lateral side in Step S200 and a transmittance curve measured at the lateral side in Step S210, as described in further detail with reference to FIGS. 5 through 7.

Figure 5:
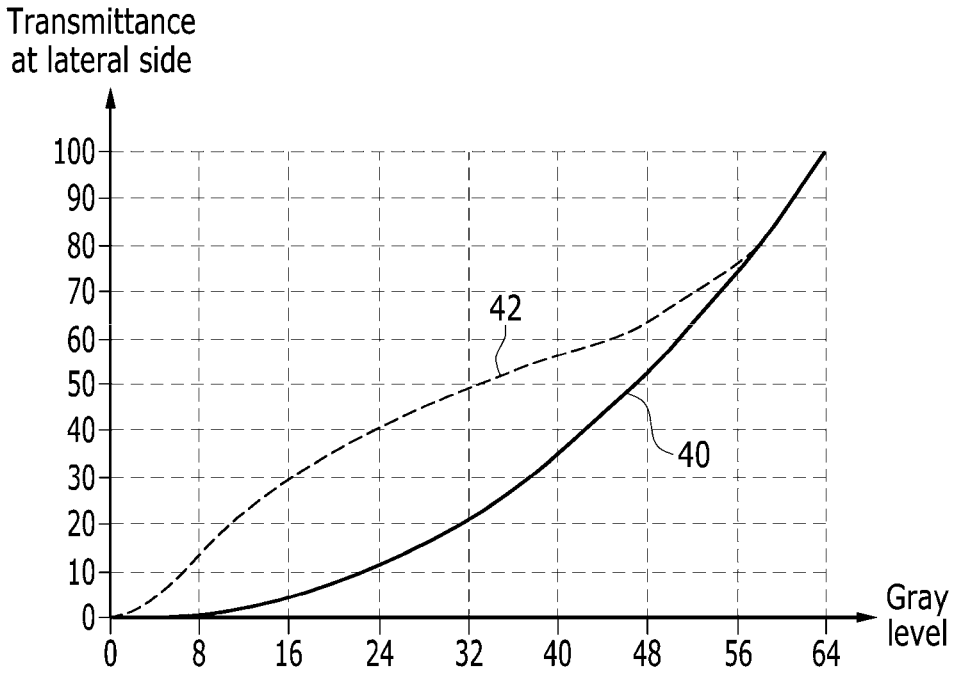
FIGS. 5 and 6 are graphs of different transmittance variations as a function of gray levels of an LCD according to an embodiment.
Figure 6:
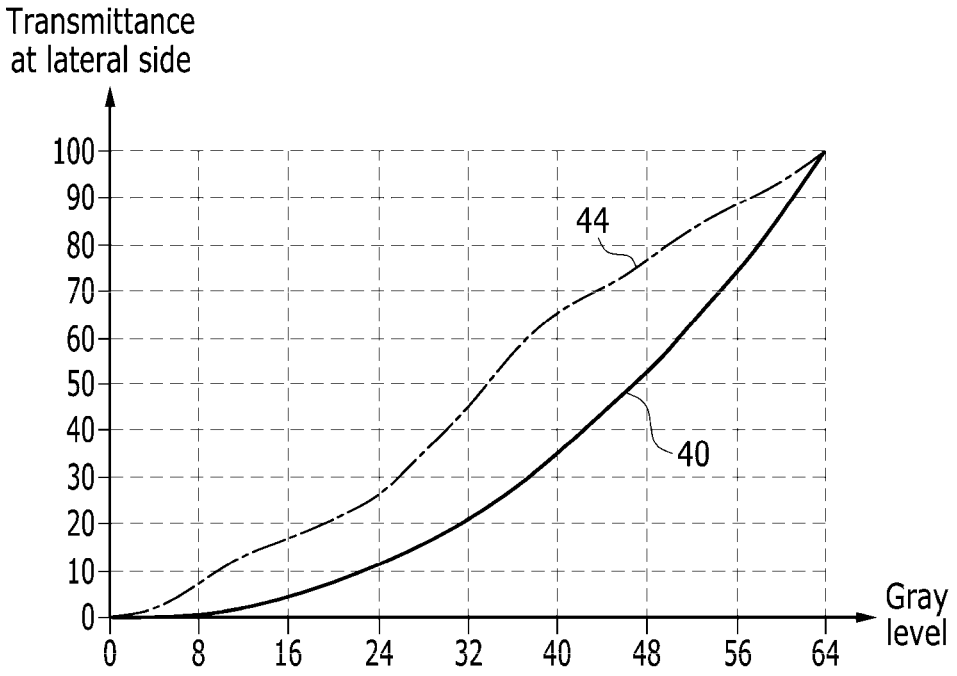

FIGS. 5 and 6 are graphs of different transmittance variations as a function of gray levels of an LCD according to an embodiment. The graphs in FIGS. 5 and 6 are superimposed together to form the graph in FIG. 7. The graph in FIG. 7 can be used to determine a specific gray level of the LCD.

As shown in FIG. 5, a transmittance curve 42 measured at the lateral side in Step S200 diverges more from a 2.2 gamma curve 40 in low gray-level areas than in high gray-level areas. In the example of FIG. 5, the 2.2 gamma curve 40 represents the transmittances according to the gray levels when the LCD is viewed from a front side.

Accordingly, when the reference voltage is identical to the data voltage, the side visibility at the low gray level decreases since the transmittance curve at the front side according to the gray levels is further away in the low gray-level areas.

In contrast, as shown in FIG. 6, a transmittance curve 44 measured at the lateral side in Step S210 diverges more from the 2.2 gamma curve 40 in the high gray-level areas than in the low gray-level areas.

Accordingly, when the reference voltage is higher than the common voltage Vcom, the side visibility at the high gray level decreases since the transmittance curve at the front side according to the gray levels is further away in the high gray-level areas.

Figure 7:
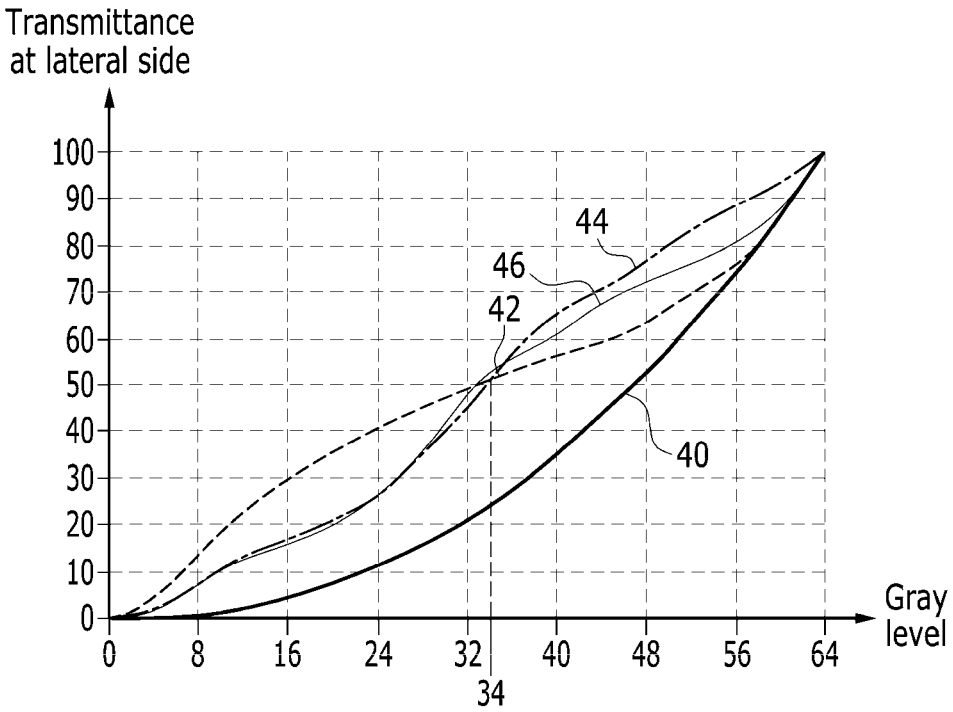
FIG. 7 is a superimposition of the graphs of FIGS. 5 and 6, and is used to determine the specific gray level of the LCD.

Referring to FIG. 7, the 2.2 gamma curve 40 and transmittance curves 42 and 44 in FIGS. 5 and 6 are superimposed together. As shown in FIG. 7, the gray-level value, at a point at which the transmittance curve 42 measured at the lateral side in the step S200 crosses the transmittance curve 44 measured at the lateral side in the step S210, may be determined to be the specific gray level.

For example, in the graph of FIG. 7, the specific gray level is determined to be a 34 gray level.

The specific gray-level value determined in Steps S200 to S220 may be stored in the memory inside the signal controller 100.

When gray-level data corresponding to a pixel PX disposed in the display panel 140 exceeds a specific gray-level value, the signal controller 100 outputs a signal to the reference voltage generator 130 such that the reference voltage applied to the pixel PX is identical to the data voltage applied to the pixel (Step S120).

Depending on the signal output from the signal controller 100, the reference voltage generator 130 may apply the same voltage as the data voltage to the pixel PX when the data voltage is applied to the pixel PX.

Accordingly, the voltage divided by the second subpixel PX_L in the pixel PX may be given by the following equation:

$$VL = Vcst \times \left(\frac{R_{RD}}{R_{LOW} + R_{RD}}\right) + Vdata \times \left(\frac{R_{LOW}}{R_{LOW} + R_{RD}}\right) \quad \text{Equation (1)}$$

In Equation (1), VL is the voltage divided by the second subpixel PX_L, Vcst is the reference voltage provided to the pixel PX, Vdata is the data voltage provided to the pixel, RRD is a resistance of the third switching element T_RD, and RLOW is a resistance of the second switching element T_L.

Since the data voltage is the same as the reference voltage, voltage division by the third switching element T_RD will not occur, and thus the second subpixel operates as a pixel having a low visibility structure.

When the gray-level data corresponding to a pixel disposed in the display panel 140 does not exceed the specific gray-level value, the signal controller 100 outputs a signal to the reference voltage generator 130 such that the reference voltage applied to the pixel is greater than the common voltage Vcom by a predetermined level α (S130).

Depending on the signal output from the signal controller 100, the reference voltage generator 130 may provide the reference voltage (that is greater than the common voltage by the predetermined level α) to the pixel PX when the data voltage is applied to the pixel PX. For example, in some embodiments, the reference voltage may be higher than the common voltage by 1.5 V. According to Equation (1), the voltage is then divided by the second subpixel PX_L.

Accordingly, when the reference voltage is identical to the data voltage and the reference voltage is provided to the pixel PX corresponding to the high gray-level image signal, the side visibility is improved since the transmittance curve measured at the lateral side in the high gray-level area diverges less from the 2.2 gamma curve 40, as shown in FIG. 5.

In addition, when the reference voltage is higher than the common voltage and the reference voltage is provided to the pixel PX corresponding to the low gray-level image signal, the side visibility is improved since the transmittance curve measured at the lateral side in the low gray-level area diverges less from the 2.2 gamma curve 40, as shown in FIG. 6.

That is, as shown in FIG. 7, the transmittance curve at the lateral side of the LCD according to the exemplary embodiment diverges less from the 2.2 gamma curve 40 in both the low and high gray-level areas, thereby improving the side visibility of the display panel.

The above-described methods of determining a specific gray level of an LCD may be implemented as a code in a computer readable medium in which a program is recorded. The computer readable medium may include all kinds of recording apparatuses in which data that may be read by a computer system are stored. Examples of the computer readable medium may include a hard disk drive (HDD), a solid state disk (SSD), a silicon disk drive (SDD), a read only memory (ROM), a random access memory (RAM), a compact disk read only memory (CD-ROM), a magnetic tape, a floppy disk, an optical data storage, or the like, and may also include a medium implemented in a form of a carrier wave (for example, transmission through the Internet).

While the inventive concept have been illustrated and described with reference to exemplary embodiments, it will be understood by one of ordinary skill in the art that various changes may be made to the embodiments without departing from the spirit and scope of the inventive concept.

What is claimed is:

1. A liquid crystal display (LCD) comprising: a display panel including a plurality of pixels connected to a gate line, a data line, and a reference voltage line to which a common voltage is applied;

a data driver connected to the data line and configured to apply a data voltage to the data line;

a gate driver connected to the gate line and configured to apply a gate voltage to the gate line;

a reference voltage generator connected to the reference voltage line and configured to apply a reference voltage to the reference voltage line;

a memory containing information about a specific gray-level value; and a signal controller configured to control the data driver, the gate driver, and the reference voltage generator, and compare the specific gray-level value with a gray-level value of an image data, so as to output a signal to the reference voltage generator for changing the reference voltage applied to the pixel, wherein the specific gray-level value is determined by using a first transmittance measured at a lateral side of the display panel when the reference voltage is identical to the data voltage, and a second transmittance measured at the lateral side of the display panel when the reference voltage is higher than the common voltage by more than a predetermined level, and wherein the specific gray-level value is determined to be a gray-level value at a point which a curve of the first transmittance measured at the lateral side of the display panel crosses a curve of the second transmittance measured at the lateral side of the display panel.

2. The LCD of claim 1, wherein the signal controller is configured to output the signal to the reference voltage generator for changing the reference voltage, such that the reference voltage is identical to the data voltage when the gray-level value of the image data exceeds the specific gray-level value.

3. The LCD of claim 1, wherein the signal controller is configured to output the signal to the reference voltage generator for changing the reference voltage, such that the reference voltage is higher than the common voltage by more than a predetermined level when the gray-level value of the image data is below the specific gray-level value.

4. The LCD of claim 1, wherein the data line and the reference voltage line are disposed parallel to each other.

5. The LCD of claim 1, wherein the pixel includes a high gray-level subpixel and a low gray-level subpixel, the high gray-level subpixel including a high gray-level liquid crystal capacitor and a high gray-level switching element, the low gray-level subpixel including a low gray-level liquid crystal capacitor, a low gray-level switching element, and an auxiliary switching element, wherein the reference voltage is applied to an output terminal of the auxiliary switching element.

6. The LCD of claim 5, wherein an input terminal of the auxiliary switching element is connected to an output terminal of the low gray-level switching element, and a control terminal of the auxiliary switching element is connected to the same gate line as a control terminal of the low gray-level switching element.

7. The LCD of claim 6, wherein the pixel includes a horizontal-type pixel.

8. A method of driving a liquid crystal display (LCD), comprising:

receiving an image data;

comparing a gray-level value of the image data with a specific gray-level value to obtain a comparison result; and changing, based on the comparison result, a reference voltage applied to a pixel, such that the reference voltage is higher than one of a data voltage and a common voltage applied to the pixel by a predetermined level, wherein the specific gray-level value is determined using a first transmittance measured at a lateral side of a display panel when the reference voltage is identical to the data voltage, and a second transmittance measured at the lateral side of the display panel when the reference voltage is higher than the common voltage by more than the predetermined level, and wherein the specific gray-level value is determined to be a gray-level value at a point which a curve of the first transmittance measured at the lateral side of the display panel crosses a curve of the second transmittance measured at the lateral side of the display panel.

9. The method of claim 8, wherein changing the reference voltage includes making the reference voltage identical to the data voltage when the gray-level value of the image data exceeds the specific gray-level value.

10. The method of claim 8, wherein changing the reference voltage includes making the reference voltage higher than the common voltage by more than the predetermined level when the gray-level value of the image data is below the specific gray-level value.

11. The method of claim 8, wherein, when the pixel includes a high gray-level subpixel and a low gray-level subpixel, the high gray-level subpixel including a high gray-level liquid crystal capacitor and a high gray-level switching element, and the low gray-level subpixel including a low gray-level liquid crystal capacitor, a low gray-level switching element, and an auxiliary switching element:

the reference voltage is applied to an output terminal of the auxiliary switching element such that the data voltage is divided by the low gray-level liquid crystal capacitor.

* * * * *